United States Patent [19]

McEathron

[11] Patent Number: 5,007,121

[45] Date of Patent: Apr. 16, 1991

[54] HYDRAULIC LIFT FOR BATHTUBS

[76] Inventor: Robert J. McEathron, 857 Townsite Road, Nanaimo, British Columbia, Canada, V9S 1L8

[21] Appl. No.: 529,789

[22] Filed: May 29, 1990

Related U.S. Application Data

[63] Continuation of Ser. No. 244,700, Sep. 14, 1988, abandoned.

[51] Int. Cl.[5] ..... A47K 3/12

[52] U.S. Cl. ..... 4/566; 254/10 C

[58] Field of Search ..... 4/560–566; 254/10 B, 10 C

[56] References Cited

U.S. PATENT DOCUMENTS

| | | | |
|---|---|---|---|
| 1,118,740 | 11/1914 | Chapman et al. | 254/10 C |
| 1,230,739 | 6/1917 | McCallum | 254/10 C |
| 1,348,294 | 8/1920 | Moeller | 254/10 C |
| 2,772,721 | 12/1956 | Saunders | 4/560 X |
| 3,091,778 | 6/1963 | Gross | 4/566 |
| 3,106,723 | 10/1963 | Carpenter | 4/564 |
| 3,400,410 | 9/1968 | Sallinger . | |
| 3,441,960 | 5/1969 | Norton | 4/562 |
| 3,624,666 | 11/1971 | Higgins | 4/562 |
| 3,714,672 | 2/1973 | Condon | 4/563 |
| 4,128,904 | 12/1978 | Ekman et al. | 4/560 X |
| 4,419,776 | 12/1983 | Schmidt . | |
| 4,555,089 | 11/1985 | Eck | 254/10 B |
| 4,557,002 | 12/1985 | Schmidt . | |
| 4,574,408 | 3/1986 | Dentler et al. . | |
| 4,660,234 | 4/1987 | Schmidt . | |

*Primary Examiner*—Charles E. Phillips
*Attorney, Agent, or Firm*—Barrigar & Oyen

[57] ABSTRACT

Prior hydraulic lifts for bathtubs have required complicated installation and a dedicated source of hydraulic pressure. The present invention provides a bathtub lift operated by the domestic water pressure and which uses simple hydraulic cylinders.

4 Claims, 3 Drawing Sheets

HYDRAULIC LIFT FOR BATHTUBS

This application is a continuation of application Ser. No. 07/244,700, filed Sept. 14, 1988, now abandoned.

The invention relates to bathtub lifts for assisting individuals in entering and exiting a bathtub, and more particularly to bathtub lifts which utilize the bathtub water supply to provide hydraulic pressure to raise and lower the lift.

BACKGROUND OF THE INVENTION

Conventional bathtubs are very difficult for handicapped or infirm individuals to climb into or out of. Various devices have been designed to provide a power-assisted lift to raise and lower the individual from the level of the bathtub rim to the bottom of the tub.

For example, U.S. Pat. No. 3,106,723 issued Oct. 15, 1963 to Carpenter discloses a power-elevatable bath tub seat which uses a vertically aligned compressed air cylinder to raise and lower a seat platform. Considerable permanent modification to the existing bathtub is required in this device, as a source of compressed air pressure is required and the power cylinder is installed in a recess in the floor below the tub to extend vertically through the bottom of the tub.

U.S. Pat. No. 3,400,410 issued Sept. 10, 1968 to Sallinger discloses a bathtub device designed to be manufactured of lightweight aluminum frame. The manual rotation of a crank handle is used to raise and lower the seat. This device takes considerable time and energy for an individual to raise or lower by himself or herself.

U.S. Pat. Nos. 4,419,776; 4,557,002 and 4,660,234 all issued to Schmidt disclose various designs for bathtub lifts which utilize the household water pressure to raise the seat platform. These devices use flexible hoses or bellows which fill with water under pressure to force the seat platform upwardly. Such devices have not been found to be sufficiently reliable to achieve commercial success.

There is therefore a need for a bathtub lift which can be readily installed without modifying the bathtub structure, is able to work from the water pressure provided by the household water supply, and which operates effectively to raise and lower the individual in the bathtub.

SUMMARY OF THE INVENTION

The present invention provides a bathtub lift which comprises a base frame, a seat platform, two arms hingedly connecting the seat plate to the base frame, a sleeve pivotally mounted in the seat platform, and a hydraulic cylinder connected to a water supply and having a casing, a cylinder chamber, a piston and a piston rod mounted for reciprocal movement in the chamber. The end of the piston rod is connected to the sleeve and the end of the casing remote from the end of the piston rod is pivotally mounted on the base frame.

BRIEF DESCRIPTION OF THE DRAWINGS

In drawings which illustrate a preferred embodiment of the invention.

DETAILED DESCRIPTION OF A PREFERRED EMBODIMENT

Figure 1:
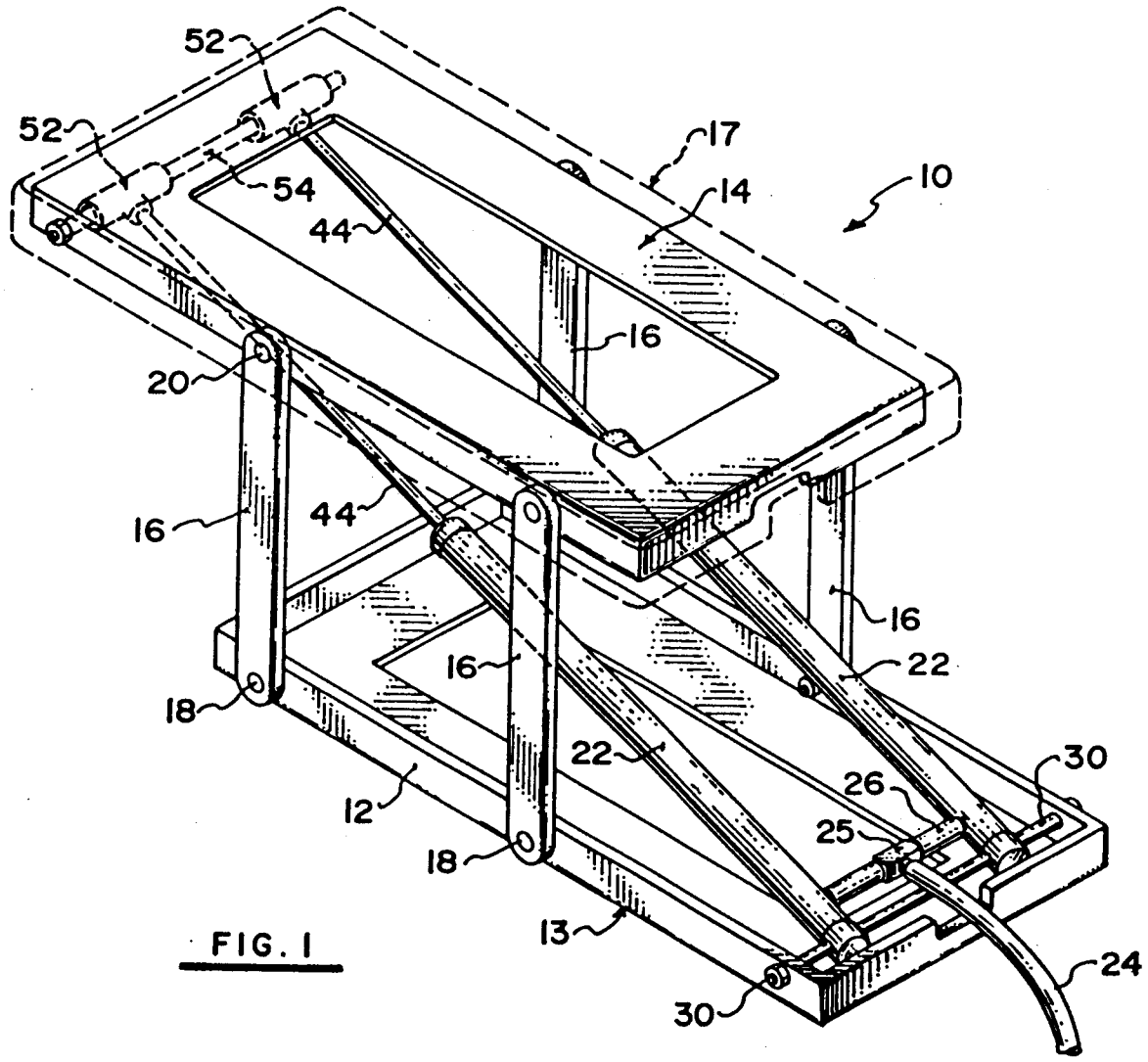
FIG. 1 is a perspective view of the invention in raised position.

With reference to FIG. 1, the bathtub lift of the invention is designated generally as 10. It consists essentially of a base 12 and a platform 14 connected to the base by four hinged arms 16. Base 12 is sized to fit in the bottom of a standard bathtub, and has a sufficiently broad surface 13 to provide a stable support. Arms 16 are of such length that when platform 14 is in the raised position, and base 12 is positioned on the bottom of the bathtub, the upper surface, seat plate 17 of platform 12 is approximately level with the upper edge of the bathtub. The lift may be manufactured of any material which is sufficiently strong and resistant to corrosion.

Figure 2:
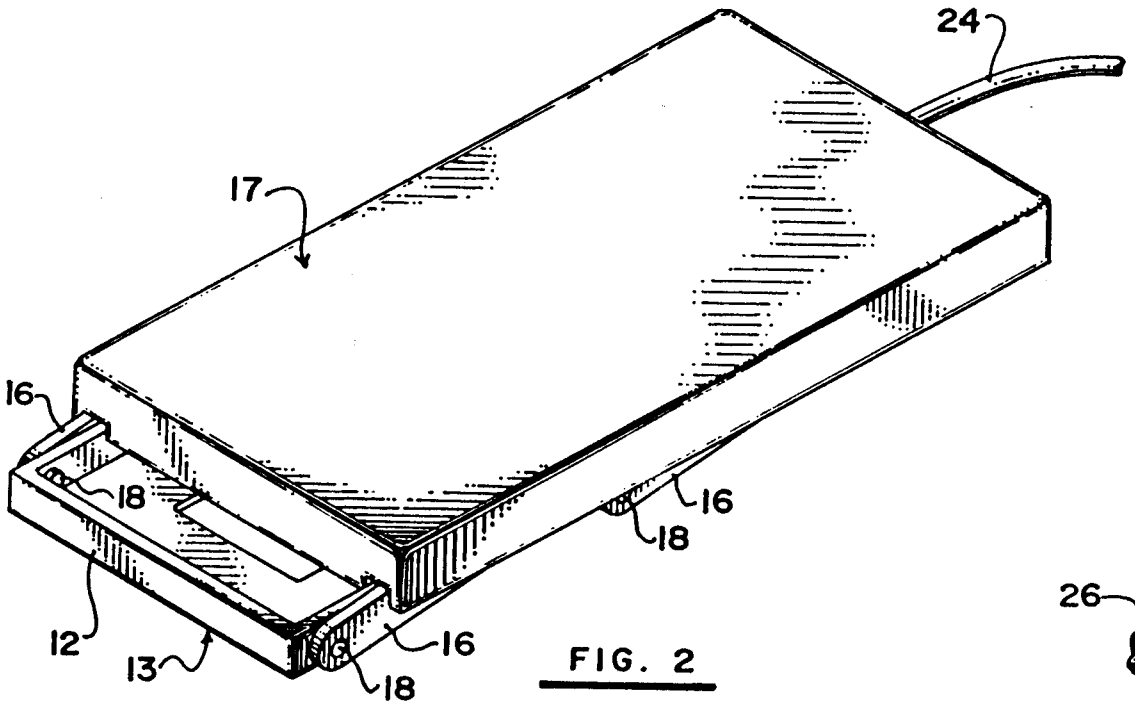
FIG. 2 is a perspective view of the invention shown in FIG. 1 in lowered position.

Each arm 16 is hingedly connected to base 12 at lower joint 18 by a nut and bolt or similar connection, and similarly to platform 14 at point 20. Platform 14 is thus free to move between the lowered position shown in FIG. 2 and the raised position shown in FIG. 1, constrained only by the presence of hydraulic cylinders 22. Hydraulic cylinders 22 serve to provide the lifting power to raise the platform 14 when it is under load, and to allow it to lower at a controlled rate.

Hydraulic cylinders 22 are connected by water line 24 to the household water supply, whether through the bathtub faucet or showerhead or through some other connection. For example a diverter valve may be used to connect hose 24 to the bathtub faucet and thereby allow the water supply to be used either to fill the tub or supply the hydraulic cylinders. Alternatively the hose could be connected directly to the shower head. A three-way ball valve is used to control the flow of water to the cylinders. Such valve is provided with a drain outlet, an inlet from the water source and an outlet to the cylinders Hose 24 is connected to the cylinders via a T-joint 25 with individual lines 26 supplying each cylinder with water.

Figure 5:
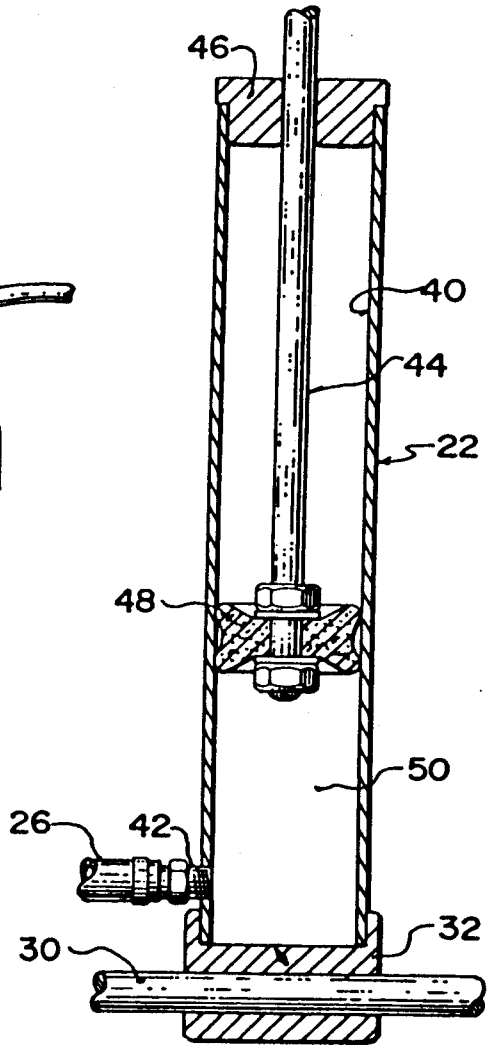
FIG. 5 is a cross-sectional view of a hydraulic cylinder of the invention.
Figure 4:
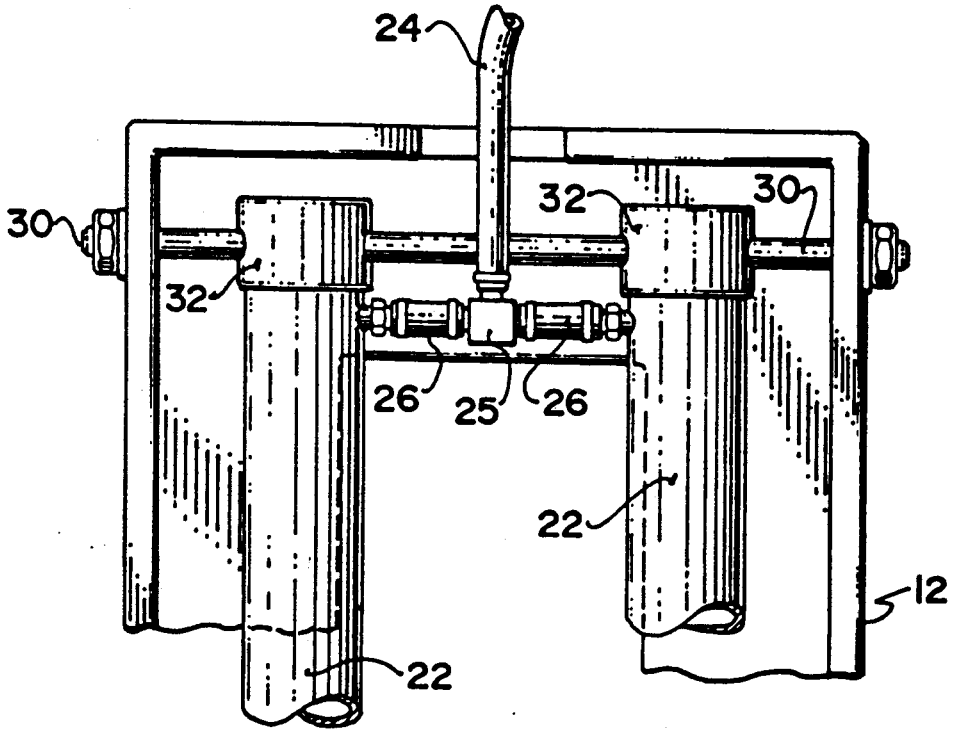
FIG. 4 is a view from above of the end of the base showing the connection of the cylinders to the base.

The lower end of each cylinder 22 is pivotally mounted on bar 30 as shown in FIG. 4. This is accomplished simply by providing a hole 32 through the lower casing of the cylinder. As shown in FIG. 5, each cylinder 22 has a cylindrical casing 40, a water inlet 42, piston rod 44, piston cap 46, and piston 48. Piston 48 slides within the hollow interior 50 of casing 40, forming a water-tight seal.

Figure 3:
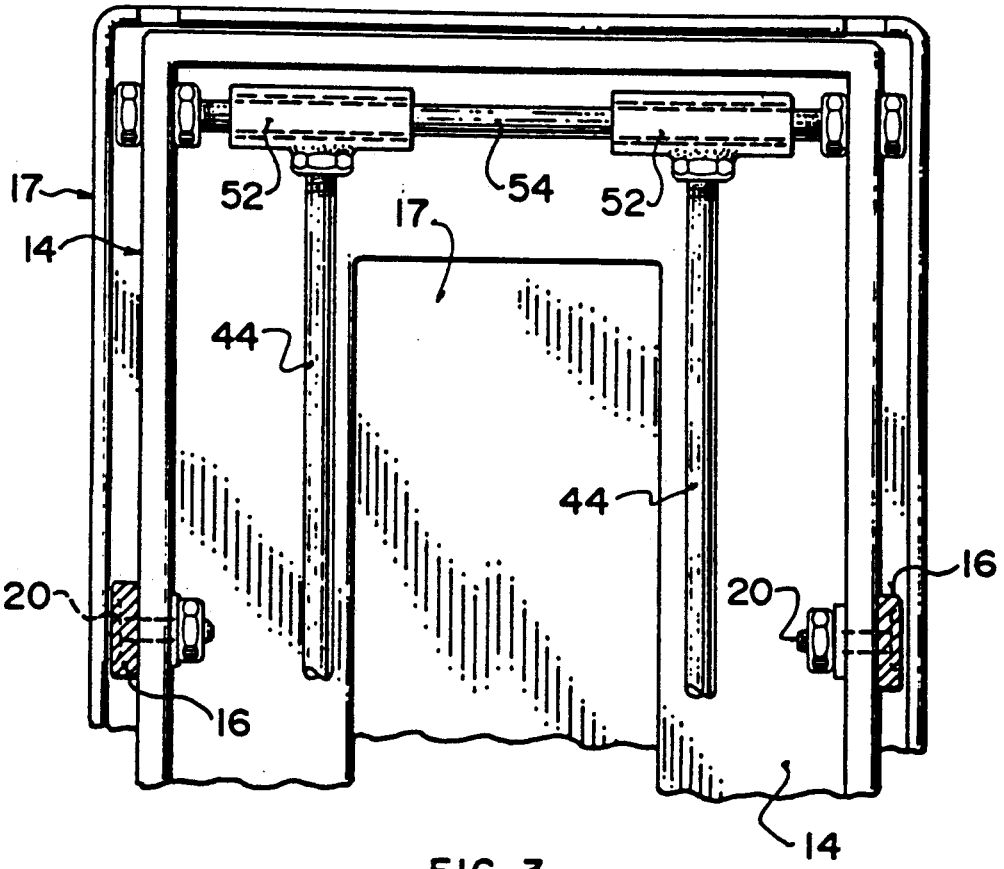
FIG. 3 is a view from below of the end of the seat platform of the invention showing the connections of the cylinders to the seat platform.

As shown in FIG. 3, the end of each piston rod 44 is mounted in a cylindrical sleeve 52 which in turn is pivotally mounted on bar 54 fixed in platform 14. In operation, the user will fill the bathtub with water and then operate the lift to raise it to the upper position. The water supply is activated and the ball valve opened to allow water to enter the interior of casing 40 through inlet 42 under pressure and forces piston 48 to move up the cylinder, driving piston rod 44 outwardly and thereby raising platform 14. The rotation of sleeve 52 allows the platform to rise in an arc. Once the platform has been raised, the user positions himself or herself on the platform. The water supply to the cylinder is then stopped and the drain on the ball valve opened to release the water pressure, allowing the platform to lower at a controlled rate.

Once the user is finished bathing the ball valve drain is closed and the process repeated to raise the user to the upper edge of the bathtub for easy egress.

The cylinders for the present invention can be constructed from a standard bicycle pump. The leather piston from the original air pump is replaced with a rubber grommet which is secured to the piston rod by two nuts on the threaded end of the piston rod. The one-way check valve on the pump is replaced by an ordinary two-way fitting to form inlet 42. The rubber grommet preferably has a concave outer edge which can be filled with grease to form a water-tight seal. Two cylinders created in this way have been found to have suitable power when operating on the household water pressure to operate the bathtub lift effectively.

To limit the maximum extension of the piston rod, a pin (not shown) may be provided in the end cap 46 of the cylinder against which the piston will abut to prevent further movement. Alternatively, a hole may be positioned in the casing adjacent the end of the cylinder which will release the water under pressure when the piston approaches the end of the cylinder.

As will be apparent to those skilled in the art, various modifications and adaptations of the structure above described may be made without departing from the spirit of the invention, the scope of which is to be construed in accordance with the accompanying claims.

I claim:

1. A device for raising and lowering a person in a bathtub, comprising:

(a) a base frame sized to fit in the bottom of a standard bathtub and having first and second opposing sides and forward and rearward ends;

(b) a substantially horizontal platform having first and second opposing sides and forward and rearward ends which correspond to those of said base frame;

(c) two pairs of rigid support members of equal length, each support member having upper and lower ends, the upper ends of the first pair of support members being pivotally attached about fixed pivot points at spaced locations to one side of said platform and the lower ends of said first pair of support members being pivotally attached, about fixed pivot points at spaced locations to one side of said base, and the upper ends of the second pair of support members being pivotally attached about fixed pivot points at spaced locations to the second side of said platform and the lower ends of said second pair of support members being pivotally attached about fixed pivot points at spaced locations to the second side of said base, the distance between the points of attachment of said upper ends of a pair of support members being approximately equal to the distance between the points of attachment of said lower ends of said pair of support members, whereby at any point during upward motion of said platform relative to said base the said four points of attachment of each pair of support members forms a parallelogram with the base frame and platform; and (d) means for pivoting said platform relative to said base comprising a pair of hydraulic cylinders connected to household water supply for hydraulic pressure and each having a first end pivotally connected to said base via a bar, the axis of rotation of said pivotal connection of said first end of said hydraulic cylinders being perpendicular to the length of said base and located closer to said rearward end of said base than said pivotal connections of said lower ends of said support members, and a second end pivotally connected to said platform via a sleeve, the axis of rotation of said pivotal connection of said second end of said hydraulic cylinders being perpendicular to the length of said horizontal platform and located closer to said forward end of said platform than said pivotal connections of said upper ends of said support members.

2. The device of claim 1 wherein said hydraulic cylinder comprises a cylinder chamber formed in said casing, means communicating said hydraulic pressure to the interior of said casing, a piston and piston rod mounted for reciprocal movement in said casing, wherein one end of said piston rod is pivotally connected to said platform and the end of the casing remote from said end of said piston rod is connected to said base frame.

3. The device of claim 2 further comprising a sleeve pivotally mounted on a horizontal axle fixed to said platform and extending between the sides of said platform, and wherein said one end of said piston rod is connected to said sleeve.

4. The device of claim 1 further comprising two sleeves pivotally mounted on an axle fixed to said platform, and wherein one end of each said piston rod is connected to one of said sleeves.

* * * * *